US005746151A

United States Patent [19]

Hestehave et al.

[11] Patent Number: 5,746,151

[45] Date of Patent: May 5, 1998

[54] MULTI-FUNCTIONAL CARRIER FOR SAILBOATS

[75] Inventors: Borge Hestehave, Alta Loma; Kjeld Hestehave, Upland, both of Calif.

[73] Assignee: Bomatic, Inc., Ontario, Calif.

[21] Appl. No.: 597,460

[22] Filed: Feb. 2, 1996

[51] Int. Cl.[6] ..... B63B 8/00

[52] U.S. Cl. ..... 114/343; 114/90; 441/1

[58] Field of Search ..... 114/39.1, 39.2, 114/89, 90, 97, 343, 344, 364, 363, 256; 211/60.1, 70.8; 224/325, 400, 309, 922; 441/1

[56] References Cited

U.S. PATENT DOCUMENTS 4,352,337 10/1982 Wyoral ..... 114/364

4,448,143 5/1984 Welsh ..... 114/90

5,005,509 4/1991 Williams ..... 114/90

5,257,590 11/1993 Foote, Jr. et al. ..... 114/343

5,435,261 7/1995 Androus ..... 114/343

*Primary Examiner*—Stephen Avila

*Attorney, Agent, or Firm*—Sixbey, Friedman, Leedom & Ferguson; David S. Safran

[57] ABSTRACT

A multi-functional hollow body for use as a boom rest or a boom and mast carrier for sailboats that is lightweight and may be positioned and secured to the boat without damaging the surface of its deck. The hollow body includes a neck and cap to allow it to also function as a liquid container. When the hollow body is sealed in an empty condition, it may also function as a flotation device, kickboard or a buoy.

17 Claims, 2 Drawing Sheets

FIG. 1
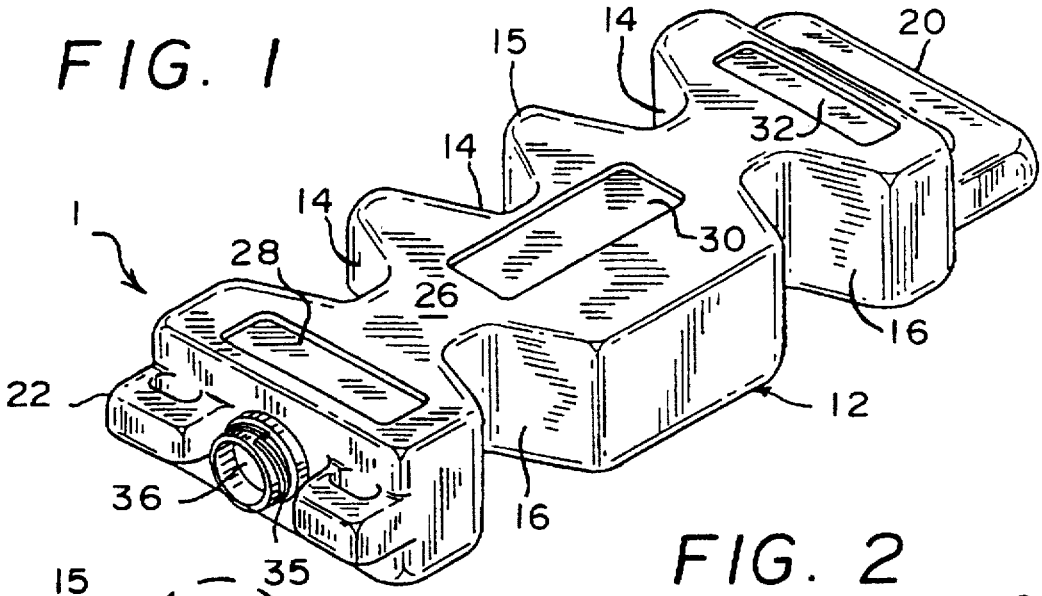
FIG. 2
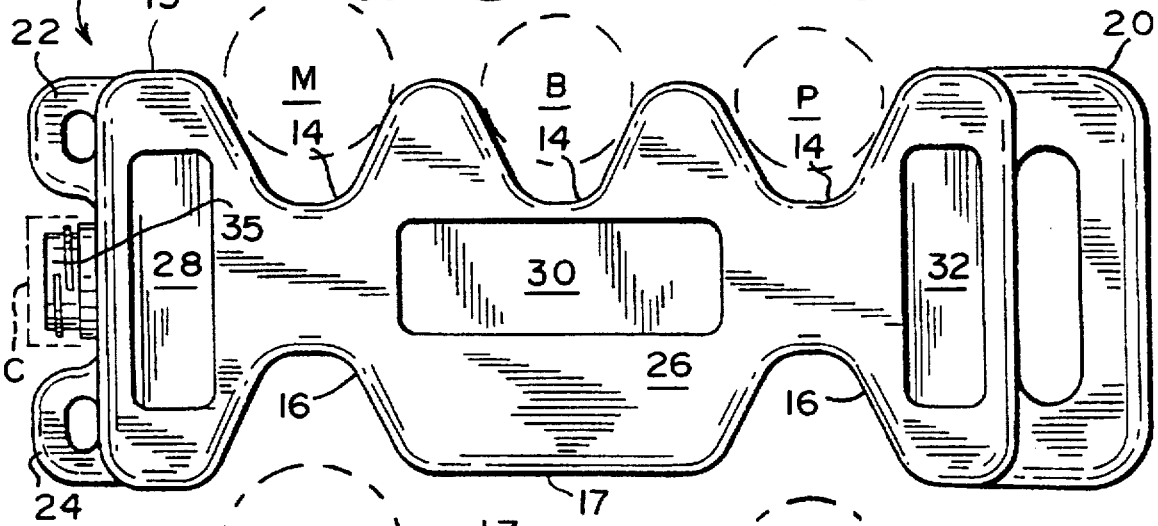
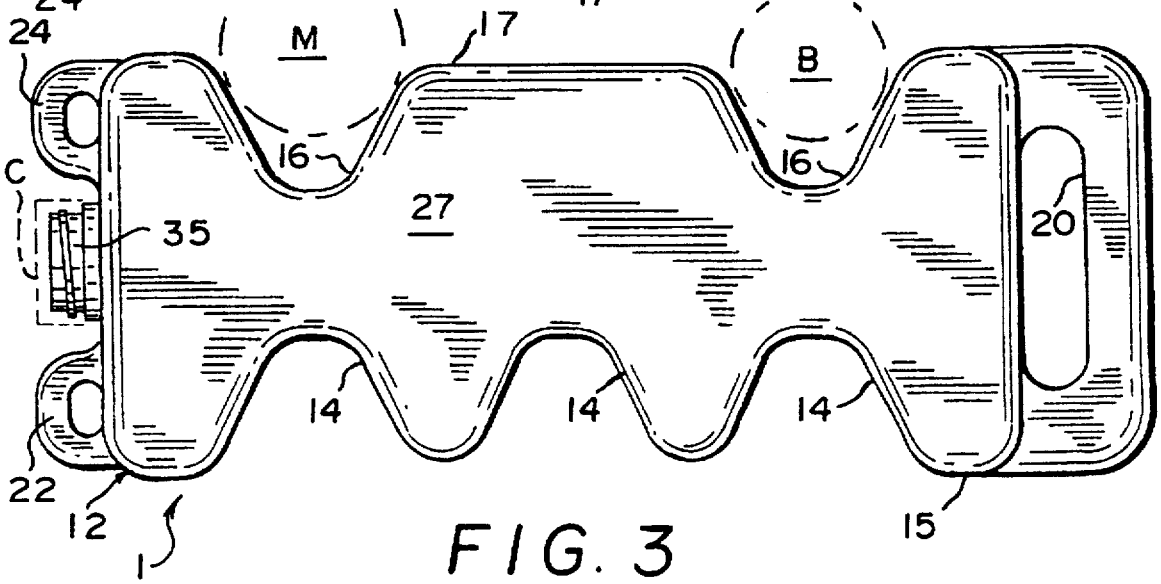
FIG. 3

MULTI-FUNCTIONAL CARRIER FOR SAILBOATS

BACKGROUND OF THE INVENTION

1. Technical Field

This invention relates to accessories for sailing vessels, and more particularly, to a multi-functional boom rest or mast and boom rest for sailing vessels that may also serve as a liquid container, flotation device, buoy or the like.

2. Description of Related Art

The popularity of sailboats has increased over the year and sailboating is no longer a sport that is primarily for the rich and for knowledgeable seamen. However, sailboats for the average person tend to smaller and sparse in their associated attachments, and tend to be towed, with the boom and mast removed, to and from the water before and after each usage, instead of being docked in the water. Furthermore, space, cost and weight become focal considerations for the average sailboater as they try to balance the problem of providing storage for additional attachments. Additionally, the average person tends to lack the skills and/or experience possessed by those for whom sailing is more than a casual hobby, nor do they want to take the time needed to perform complicated tasks "just right", which can lead to surfaces of the deck being damaged, particularly when stowing the boom and mast in preparation for towing the sailboat, or even when preparing the boat for wet dock storing with the sail furled upon the boom.

Examples of prior art boom and mast carriers, cradles, or rests for small sailboats are shown in U.S. Pat. Nos. 4,352,237 to Wyoral and 4,448,143 to Welsh. However, the structures of these patents require the use of the mast hole of the boat for supporting the stem of their bracket-like support member(s), rendering them unusable as a boom rest when the boat is docked with the sail furled on the boom with the mast in place. Furthermore, since masts are not all the same size, the stem of the support member must be sized for a particular boat or must have a mast hole adapter suitable for the user's boat.

Additionally, due to weight and space limitations, attachments for sailing vessels that perform more than one function are the most efficient solutions for the owners/users of small sailboats. However, the boom and mast carrier of the Wyoral patent has no use apart from trailering of the sailboat, and even though the sail cradle of the Welsh patent has a sealed, hollow plastic construction which enables it to also serve as a flotation device, since the cradle is formed of a pole-shape structure have a C-shape bracket on its end, it is not well suited for use as a floatation device in that it has limited buoyancy and cannot be readily used in an emergency situation, e.g., should the boat capsize, to hold a person's head above water. Additionally, being permanently sealed, the interior of the cradle is normally just wasted space.

A floatable cooler device with a central cooler compartment and a fuel compartment is shown in U.S. Pat. No. 5,435,261 to Androus. However, this device has no usefulness as a boom rest or boom and mast trailering carrier, nor is its shape well suited to use as a kickboard or emergency floatation device.

Accordingly, there is still a need for a boom and mast support that is truly multi-function, having several uses when the sailboat is in the water.

SUMMARY OF THE INVENTION

It is, therefore, a primary object of this invention to overcome the deficiencies of the prior art discussed above and to provide a boom/boom and mast rest/carrier which is not only simple and easy to use for trailing purposes but is also multi-functional when the sailboat is in the water.

In accordance with the primary object, it is a more specific object to provide a boom/boom and mast rest/carrier that not only serves as a carrier for at least one of a boom, a mast or a spinnaker, but may also be used as a floatation device, liquid container or a buoy device, It is yet another object of this invention to provide a boom/boom and mast rest/carrier apparatus for sailing vessels that may be tied to the deck of the boat without damaging the deck surface.

Another primary object of the present invention to provide a boom/boom and mast rest/carrier for sailboats which is simple in design, inexpensive to manufacture, rugged in construction, easy to use, and particularly suited to being inexpensively mass produced using conventional blow-molded container technology.

These and other objects and other objects are achieved in accordance with preferred embodiments of the present invention in which a multi-functional carrier for removably supporting at least one of a boom, mast, and spinnaker pole of a sail boat comprises a floatable hollow body having a top wall with at least one receiving means for receiving the at least one of the boom, mast and spinnaker pole, and having side walls with apertured extensions serving as means for securing said hollow body to a sailboat and as a means for holding of the carrier by a user.

In particular, the apertured extensions comprise at least one handle, and in a first embodiment, the apertured extensions further comprise a pair of apertured tabs, the handle being provided on a first side wall of the hollow body and the apertured tabs on an opposite side wall. Alternatively, in a second embodiment, the apertured extensions comprise a pair of handles, one on each of opposite sides of the hollow body.

The hollow body is provided with an opening for filling an interior space of the hollow body with a liquid and for pouring of a liquid therefrom. The opening is formed in a threaded neck with which the hollow body is provided, the threaded neck being closable by a cap.

Additionally, the hollow body possesses sufficient buoyancy to function as a personal flotation device. Furthermore, advantageously, the receiving means is shaped for receiving a chin of a user when the carrier is used as a personal flotation device. In the first embodiment, the hollow body has an elongated board shape, with the handle being provided at a narrow side thereof for enabling use of the carrier as a kickboard. In the second embodiment, the hollow body is generally wedge-shaped with a pair of handles on each of opposite sides of the hollow body near a lower and wider bottom portion thereof.

These and further objects, features and advantages of the present invention will become apparent from the following description when taken in connection with the accompanying drawings which, for purposes of illustration only, show several embodiments in accordance with the present invention.

BRIEF DESCRIPTION OF THE DRAWING

FIG. 1 is a front perspective view as seen from below and to the left showing a preferred embodiment boom and mast support in accordance with the present invention;

FIG. 2 is a front elevational view of the FIG. 1 embodiment;

FIG. 3 is an inverted rear elevational view of the FIG. 1 embodiment;

DETAILED DESCRIPTION OF PREFERRED EMBODIMENTS

Figure 4:
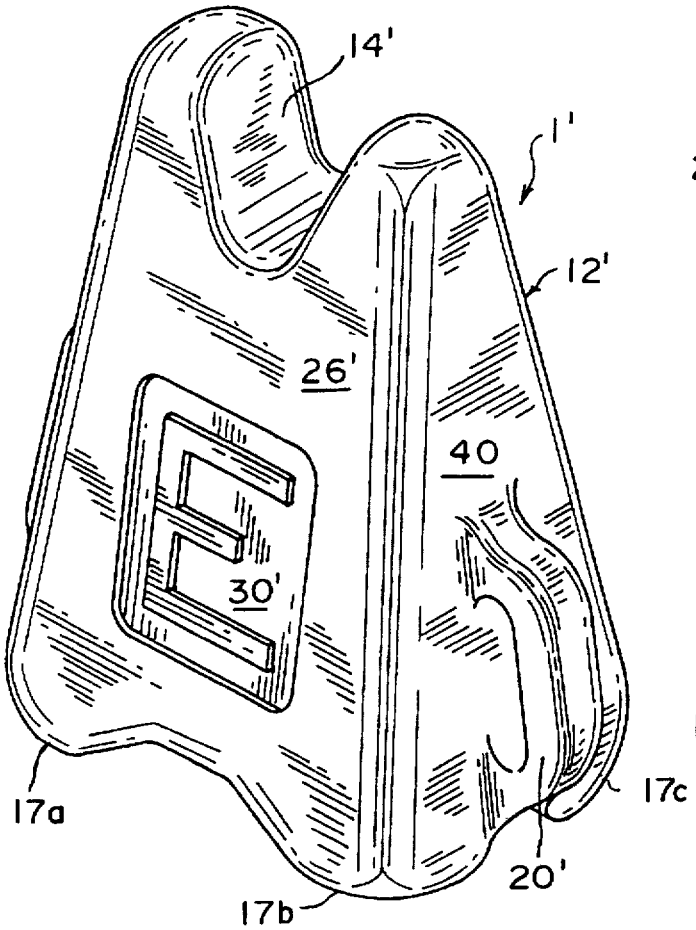
FIG. 4 is a front perspective view as seen from the front and to the right showing a preferred embodiment of a boom support.

FIG. 1 shows a first preferred embodiment of the present invention in which a boom and mast carrier 1 comprises a hollow body 12 having a first set of generally V-shaped recesses 14 in a top wall 15 and second set of generally V-shaped recesses 16 in bottom wall 17. By being V-shaped, recesses 14, 16, can accommodate booms, masts and poles of various diameters. When the hollow body 12 is resting on its bottom wall 17 (FIG. 2), the recesses 14 serve for supporting, for example, a boom B, a mast M, or a spinnaker pole P when the sailboat (not shown) of which they are a part is to be trailered. Alternatively, when inverted (as shown in FIG. 3), a boom B and mast M can be supported in recesses 16 when the sailboat is being trailered.

At a first end of the hollow body 12, a handle 20 is provided for easy carrying or securing of the boom and mast carrier 1. Two apertured tabs 22 and 24 are provided on the opposite end of the hollow body 12 for securing the carrier 1 to the sailboat. The front panel 26 of the hollow body 12 can be provided with insert recesses 28, 30 and 32 for the placement of product labels, decorations, directions for use, guidelines for emergency situations, survival techniques or the like.

The boom and mast carrier 1 is preferably formed of plastic by a conventional blow molding process; although, other molding techniques could be used instead. The use of plastic is preferred since it is strong yet light in weight, as well as being inexpensive, easy to mold, and nontoxic.

When the boom and mast carrier 1 is used as a trailering support, two such carriers 1 are positioned on the deck of the sailboat, one near the stern and one toward the bow, so as to support for opposite ends of the boom B and mast M, or boom B, mast M and spinnaker pole P in the recesses 14 or 16, so that they lie perpendicular to the front and back panels 26, 27 of each body 12. The body 12 is secured to the deck by ropes passed through the handle 20 and the tabs 22, 24, which ropes can also be passed over the boom B and mast M, or boom B, mast M and spinnaker pole P. The plastic material of which the carrier 1 is formed serves to prevent scratching of the deck surface.

In addition to serving as a boom and mast carrier, the hollow body 12 has additional functional capabilities for liquid storage, flotation support or as a buoy device. In order for the carrier 1 to function as a liquid container, the hollow body 12 has a neck 35 with a filling opening 36 through which liquid may be added to and dispensed from the hollow interior of the hollow body 12. The neck 35, which may be threaded as shown, can be closed by, e.g., a screw-on cap C (shown in phantom outline form in FIGS. 2 & 3) to prevent liquid with which the hollow body 12 has been filled from spilling out.

Still further, when the hollow body 12 is empty, with cap C in place sealing the interior of hollow body 12, the carrier 1 can be used as a buoy, flotation device, or kick board, the interior being sufficiently large to entrap enough air to provide adequate buoyancy for such purposes. The handle 20 as well as the notched planar configuration of the hollow body 12, itself, allow for easy gripping of the carrier by a person in the water, while aperture tabs 22 can be used to secure a weighted line to enable the carrier to be used as, e.g., a diver's marker buoy, to mark off an area neighboring the sailboat or to mark the position of an anchor.

Figure 5:
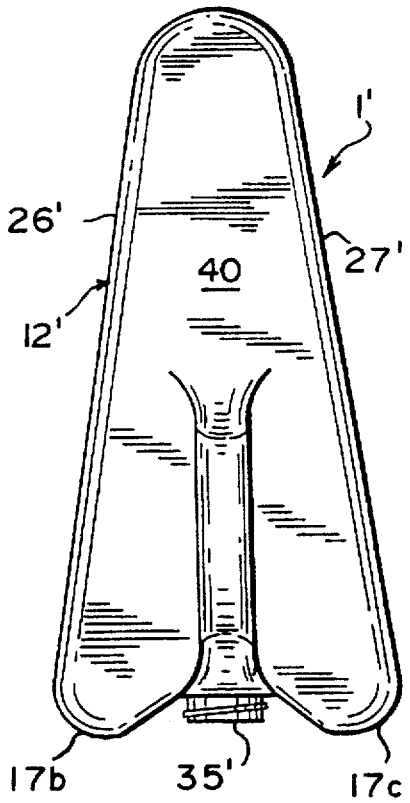
FIG. 5 is a right elevational view of the FIG. 4 embodiment.
Figure 6:
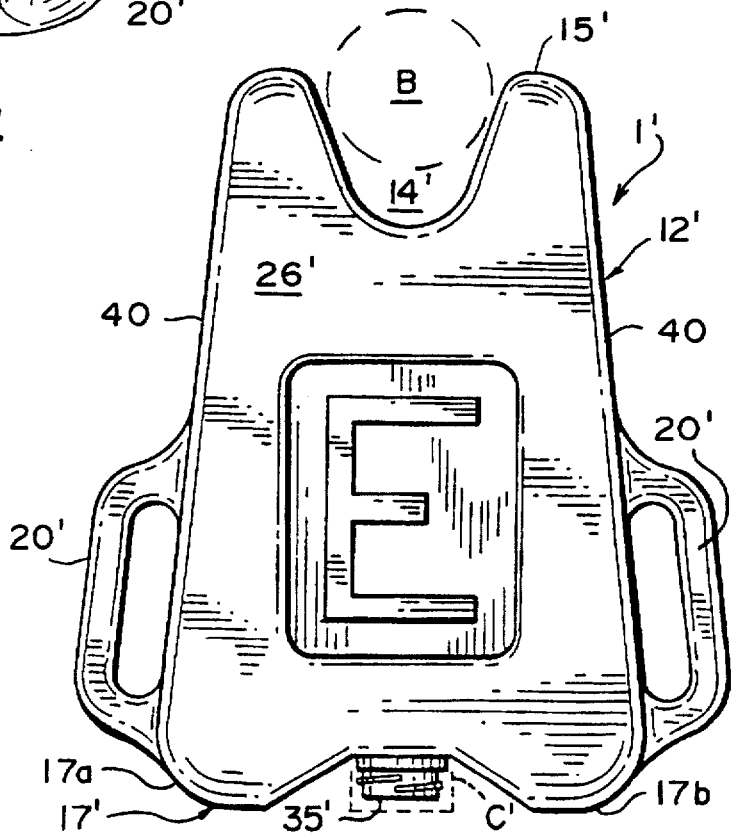
FIG. 6 is a front elevational view of the FIG. 8 embodiment.

Turning now to the second preferred embodiment which is shown in FIGS. 4–6, it is noted that the parts thereof which correspond to part shown in the embodiment of FIGS. 1–3 bear the same reference numerals but distinguished by the presence of a prime (') designation. In this case, the carrier 1' is designed for sailboats which require a boom rest, e.g., when the boat is docked or trailered with the sail furled on the boom with the mast in place.

In particular, the hollow body 12' has a generally wedge-shaped appearance with generally trapezoidal front and back panels 26', 27' and generally triangular side walls 40. In this embodiment, only a single notch-shaped recess 14' is provided in the top wall 15', in which the boom can rest with bottom of the hollow body 12' supported on the deck of the sailboat. Two handles 20' are provided, one on the lower portion of each side wall 40. These handles not only serve the function of handle 20 of the first embodiment, but also the function of apertured tabs 30, 32. Moreover, the configuration of this embodiment is particularly useful as an emergency floatation device since it may be gripped by both hands in a way that allows the recess 14 to conveniently serve as a chin rest and means for holding the user's head above water, the buoyancy of the hollow body being concentrated in the bottom portion thereof. In this regard, it is also advantageous if the handles 20' are also hollow, a characteristic easily obtained when producing the carrier 1' by blow molding.

In this second preferred embodiment, the filling neck 35' is provided recessed within the center of a recessed portion of the bottom wall 17' that is created by the formation of four leg-like members as part thereof. In this regard, only three of the four members **17*a*–17*c* can be seen in the drawings. This positioning of the neck 35' insures that its presence will not interfere with the ability of the hollow body 12' to stand on the deck of the sailboat allowing handling of the carrier 1' in the manner of a jug for pouring out the contents of the hollow body 12'** when it is used as a container.

From the foregoing, it should now be apparent how the present invention overcomes the disadvantages of known prior art structures and provides a lightweight structure for a sailboat which, although designed to serve a primary function as a boom or boom and mast carrier, is also able to function as a buoy, a floatation device or a liquid container without detracting from its primary function.

While the present invention has been shown and described herein in what is conceived to be the most practical and preferred embodiments, it is recognized that departures may be made within the scope of the invention, which is not to be limited to the details disclosed herein but is to be accorded the full scope of the claims so as to embrace any and all equivalent apparatus and articles.

I claim:

1. A multi-functional carrier for removably supporting at least one of a boom, mast, and spinnaker pole of a sail boat comprising:

a floatable hollow body having a top wall with at least one receiving means for receiving said at least one of a boom, mast and spinnaker pole, and having side walls with apertured extensions serving as means for securing said hollow body to a sailboat and as a means for holding of the carrier by a user.

2. The multi-functional carrier of claim 1, wherein said apertured extensions comprise at least one handle.

3. The multi-functional carrier of claim 2, wherein said apertured extensions further comprise a pair of apertured tabs, said handle being provided on a first side wall of the hollow body and the apertured tabs on an opposite side wall.

4. The multi-functional carrier of claim 2, wherein said apertured extensions comprise a pair of handles, one on each of opposite sides of the hollow body.

5. The multi-functional carrier of claim 1, wherein said hollow body is provided with an opening for filling an interior space of the hollow body with a liquid and for pouring of a liquid therefrom.

6. The multi-functional carrier of claim 5, wherein said opening is formed in a threaded neck with which the hollow body is provided, said threaded neck being closable by a cap.

7. The multi-functional carrier of claim 2, wherein said hollow body possesses sufficient buoyancy to function as a personal flotation device.

8. The multi-functional carrier of claim 5, wherein said receiving means is shaped for receiving a chin of a user when the carrier is used as a personal flotation device.

9. The multi-functional carrier apparatus of claim 7, wherein said hollow body has an elongated board shape, said handle being provided at a narrow side thereof enabling use of the carrier as a kickboard.

10. The multi-functional carrier apparatus of claim 7, wherein said hollow body is generally wedge-shaped; wherein said apertured extensions comprise a pair of handles, one on each of opposite sides of the hollow body near a lower and wider bottom portion thereof; and wherein said receiving means is shaped for receiving a chin of a user when the carrier is used as a personal flotation device.

11. The multi-functional carrier of claim 10, wherein said hollow body is provided with an opening for filling an interior space of the hollow body with a liquid and for pouring of a liquid therefrom.

12. The multi-functional carrier of claim 11, wherein said opening is formed in a threaded neck with which the hollow body is provided, said threaded neck being closable by a cap.

13. The multi-functional carrier of claim 11, wherein said opening is provided in a bottom wall recess formed between supporting leg formations of a bottom wall of the hollow body.

14. The multi-functional carrier of claim 1, wherein said at least one receiving means comprises a generally V-shaped recess.

15. The multi-functional carrier of claim 1, wherein at least one said receiving means comprises a plurality of V-shaped recesses.

16. The multi-functional carrier of claim 1, wherein a bottom wall of the hollow body is also provided with at least one receiving means for receiving said at least one of a boom, mast and spinnaker pole.

17. The multi-functional carrier of claim 16, wherein the at least one said receiving means of the top wall and of the bottom each comprise a plurality of V-shaped recesses.

* * * * *